United States Patent [19]

Garmon

[11] 4,244,507

[45] Jan. 13, 1981

[54] CORRUGATED CONTAINER HAVING SUPERIOR STACKING STRENGTH

[75] Inventor: Ivan E. Garmon, St. Joseph, Mo.

[73] Assignee: Champion International Corporation, Stamford, Conn.

[21] Appl. No.: 51,445

[22] Filed: Jun. 25, 1979

[51] Int. Cl.[3] ..... B65D 5/22

[52] U.S. Cl. ..... 229/33; 229/45 R

[58] Field of Search ..... 229/33, 34, 36, 44 R, 229/45

[56] References Cited

U.S. PATENT DOCUMENTS

| | | | |
|---|---|---|---|
| 2,846,132 | 8/1958 | Carpenter | 229/45 X |
| 2,858,058 | 10/1958 | Kitchell | 229/33 |
| 3,586,223 | 6/1971 | McCulloch | 229/44 R X |
| 3,973,723 | 8/1976 | Owens | 229/33 |
| 4,142,665 | 3/1979 | Jewell et al. | 229/33 |

FOREIGN PATENT DOCUMENTS

| | | | |
|---|---|---|---|
| 2240153 | 3/1975 | France | 229/31 FS |
| 979878 | 1/1965 | United Kingdom | 229/33 |

*Primary Examiner*—Davis T. Moorhead

*Attorney, Agent, or Firm*—Evelyn M. Sommer

[57] ABSTRACT

A one piece die cut blank of corrugated paperboard which is foldable into a container of generally rectangular parallelopiped configuration having a bottom wall, a pair of opposed double end walls, a pair of opposed triple side walls and a pair of cover flaps. The container provides exceptional stacking strength and can be used for holding meat products and other items that require great stacking ability.

8 Claims, 5 Drawing Figures

CORRUGATED CONTAINER HAVING SUPERIOR STACKING STRENGTH

BACKGROUND OF THE INVENTION

The present invention relates to containers and, more particularly, to containers having exceptional stacking strength.

It is common practice to package solid products such as meat products in containers for movement or shipment from one location to another. Generally speaking, the containers used for this purpose must have high stacking strength since the overall weight they must support and carry may be on the order of one hundred pounds or more.

SUMMARY OF THE INVENTION

It is an object of this invention to provide a container having superior stacking strength for use in carrying meat products and the like.

It is another object of this invention to provide a container of the type described above which can be made from a single die-cut blank of suitable material.

A container constructed according to the teachings of this invention is of a generally rectangular parallelopiped configuration and features a bottom wall, a pair of opposed double end walls, a pair of opposed triple side walls and a pair of cover flaps. The container is constructed from a single die-cut blank of corrugated paperboard which is cut and scored to define a rectangular bottom wall panel, a pair of opposed side wall panels hingedly connected to the sides of the bottom wall panel, a pair of opposed cover flaps hingedly connected to the sides of the side wall panels, a pair of opposed first end wall panels hingedly connected to the ends of the bottom wall panel, a pair of opposed second end wall panels hingedly connected to the ends of the first end wall panels, a first side wall panel section hingedly connected to each side edge of each first end wall panel and a second side wall panel section hingedly connected to each side edge of each second end wall panel and also to the first side wall panel section adjacent thereto.

To erect the blank into a container, the second end wall panels and second side wall panel sections are first folded over on their respective first end wall panels and first side wall panel sections. Then the end wall panels are folded to a vertical position relative to the bottom wall panel and the side wall panel sections folded over toward the end wall panels to form a ninety degree angle. The side wall panels are then folded to a vertical position relative to the bottom wall panel and the side panels secured to the end panels by tape or other suitable means. Finally, the cover flaps are folded down on the side wall panels to form a closed container. When so erected, the first and second end panels form a double end wall while the side panel and the first and second side wall panels sections taken together form a triple side wall.

The above and other objects will appear in the description which follows wherein reference is made to the accompanying drawings which form a part hereof and in limitation, a specific form in which this invention may be practiced. This form will be described in clear and concise terms to enable persons skilled in the packaging art to make and use the present invention, but it is to be understood that other embodiments of the invention may be used and that structural changes in the embodiments herein described may be made by those skilled in the art without departing from the true scope of the present invention. Thus, in its broader aspects, this invention is not limited to the specific constructions hereinafter described.

BRIEF DESCRIPTION OF THE DRAWINGS

In order that the invention may be more fully understood, it will now be described by way of example with reference to the drawings wherein like reference numerals represent like parts and wherein.

DETAILED DESCRIPTION OF PREFERRED EMBODIMENT

Figure 1:
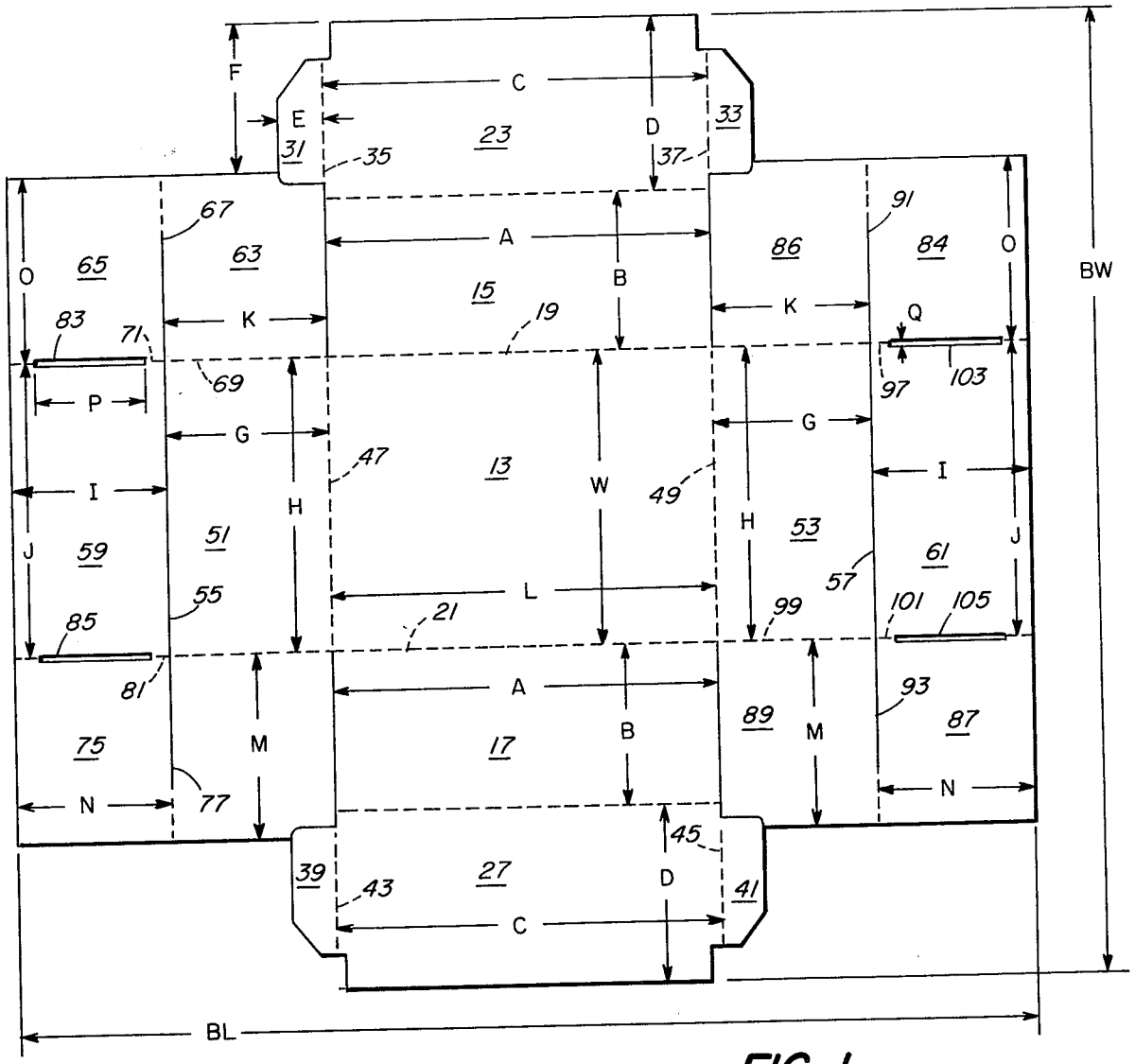
FIG. 1 is a plan view of a blank, which, when erected will form a container according to this invention.

Referring now to the drawings, and in particular to FIG. 1, there is illustrated a unitary blank 11 of corrugated paperboard or similar material cut and scored so that it can be erected into a container of generally rectangular parallelopiped configuration according to this invention.

Blank 11 is organized about a generally rectangular panel 13 which, when the blank is erected, constitutes the bottom wall of the container. A pair of rectangular side wall panels 15 and 17 are hingedly connected to bottom wall panel 13 about horizontal fold lines 19 and 21 which define the upper and lower edges, respectively, of bottom wall panel 13. A cover panel 23 of rectangular configuration is hingedly connected to side wall panel 15 about a horizontal fold line 25 which defines the upper edge of side panel 15 and a cover panel 27 is hingedly connected to side wall panel 17 about a horizontal fold line 29 which defines the lower edge of side panel 17. A pair of side flaps 31 and 33 are hingedly connected to cover panel 23 about vertical fold lines 35 and 37 which define the side edges of cover panel 23 and a pair of side flaps 39 and 41 are hingedly connected to cover panel 27 about vertical fold lines 43 and 45 which define the side edges of cover panel 27. Side flaps 31, 33, 39 and 41 are preferably of a trapezoidal configuration.

Hinged along vertical fold lines 47 and 49, which define the side edges of bottom wall panel 13, are a pair of rectangular first end wall panels 51 and 53, respectively and hinged along vertical cut and fold lines 55 and 57, which define the outer side edges of panels 51 and 53 respectively, are a pair of second end wall panels 59 and 61.

First and second rectangular side wall panel sections 63 and 65 respectively, are hingedly connected to each other in side-by-side relationship by a vertical cut and fold line 67 which defines their common side edge and are hingedly connected to first and second end wall panels 51 and 59 respectively by horizontal fold lines 69 and 71 which define the top edges of first and second end wall panels 51 and 59 respectively. First hingedly connected to each other in side-by-side relationship by a vertical cut and fold line 77 and connected for first and second end wall panels 51 and 59 respectively by horizontal fold lines 79 and 81 which define the bottom edges of first and second end wall panels 51 and 59 respectively. Slots 83 and 85 are provided along a portion of fold lines 71 and 81, respectively, to enable the panel and panel sections hingedly connected by these fold lines to be easily folded over on each other.

In a similar manner first and second panel sections 84, 86, 87, 89 are hingedly connected in pairs by vertical cut and fold lines 91 and 93 and hingedly connected to first and second end panels 53 and 61 by horizontal fold lines 95, 97, 99 and 101, fold lines 97 and 101 having slots 103 and 105 corresponding to slots 83 and 85.

Typical dimensions of the blank and the various panel and panel sections formed thereon according to this invention are as follows:

Overall length BL of blank H 57¼
Overall width BW of blank 11 54¾
Length L of panel 13 21¾
Width W of panel 13 16¾
Length A of panels 15 and 17 22
Width B of panels 15 and 17 9⅛
Length C of panels 23 and 27 22¼
Width D of panels 23 and 27 9 7/8
Length E of flaps 31, 33, 39 and 41 2½
Width F of flaps 31, 33, 39 and 41 7 7/8
Length G of panels 51 and 53 8 15/16
Width H of panels 51 and 53 16 5/8
Length I of panels 59 and 61 8 13/16
Width J of panels 59 and 61 16½
Length K of panel sections 63, 73, 85 and 89 8 15/16
Width M of panel sections 63, 73, 85 and 89 10½
Length N of panel sections 65, 75, 83 and 87 8 13/16
Width O of panel sections 65, 75, 83 and 87 10 5/8
Length P of slots 83, 85, 103 and 105 6¾
Width Q of slots 83, 85, 103 and 105 ⅛

The stock material for blank 11 may be, for example heavy, B-flute single-wall corrugated paperboard having a corrugating medium and two plain liner sheets adhesively bonded thereto.

When using the dimensions listed above, the container will have an overall length of 21¾ inches, an overall width of 16¾ inches and an overall height of 9⅛ inches.

The container is erected from blank 11 in the following manner.

Figure 2:
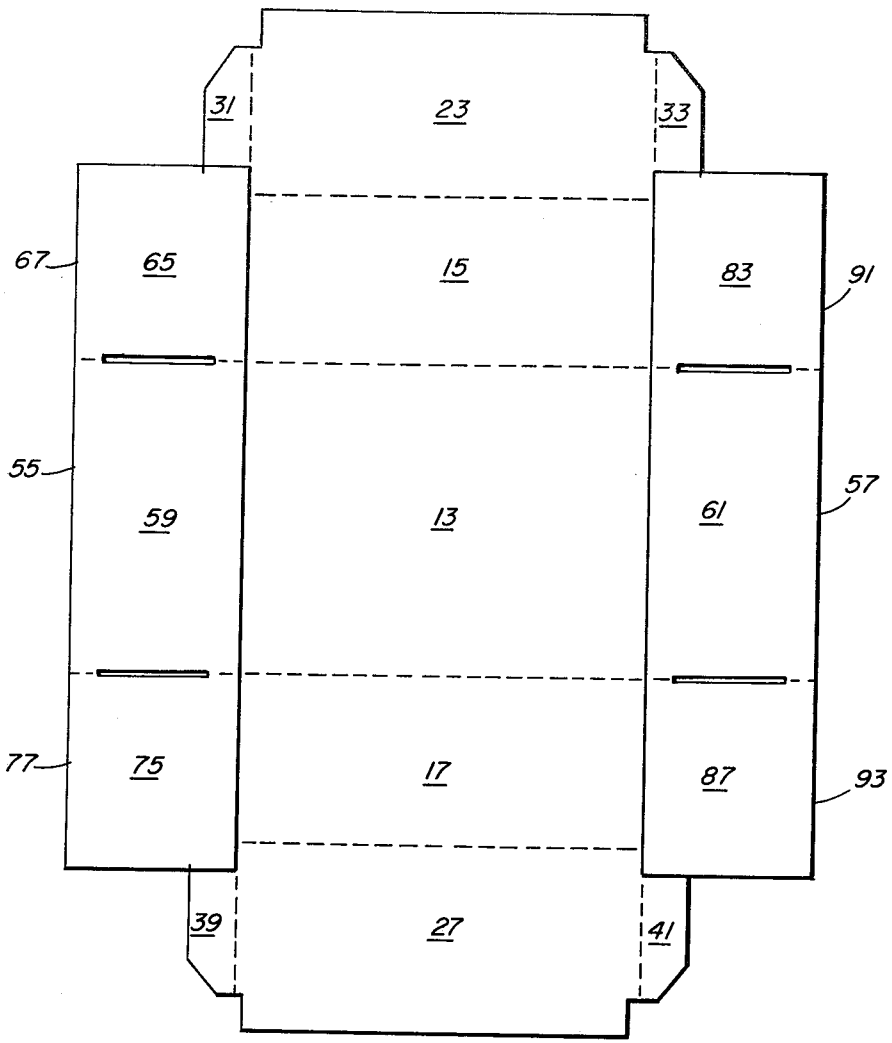

First, as illustrated in FIG. 2, the second side panel sections 65, 75, 84 and 87 and the second end panel sections 59 and 61 are folded over on their respective first side panel sections 63, 73, 86 and 89 and first end panels 51 and 53 in overlaying relationship about their respective fold lines 67, 77, 91, 93, 55 and 57.

Figure 3:
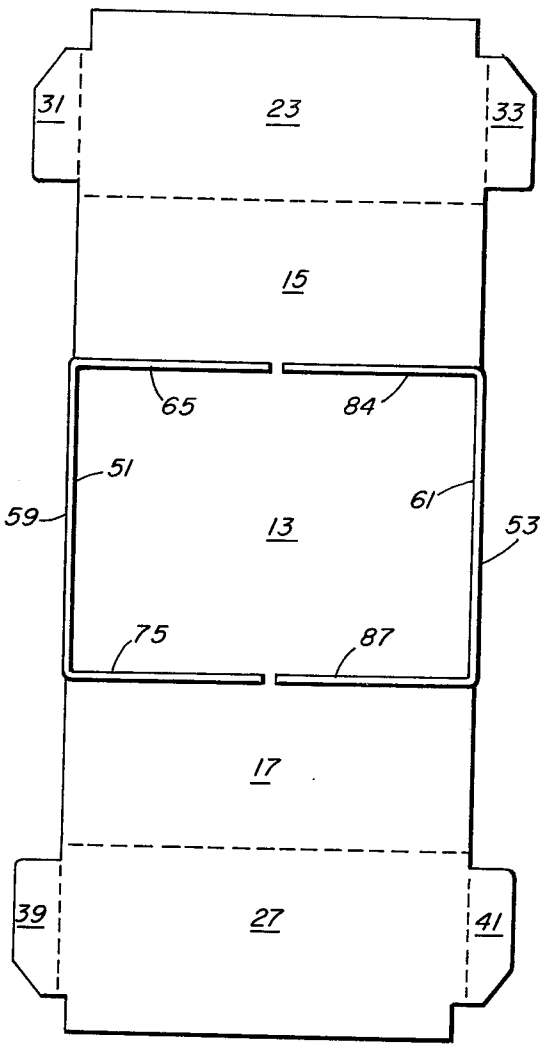
FIGS. 2 to 4 inclusive are perspective views of the various stages of assembly of the blank of FIG. 1 to form the container.

Then side panel pairs 51, 59 and 53, 61 are folded about fold lines 47 and 49 respectively to a vertical position relative to bottom wall 13. After that, side panel sections 63, 65, 73, 75, 83, 85, 87 and 89 are folded over on end panels 51, 53, 59 and 61 to an angle of ninety degrees about their respective fold lines 69, 71, 79, 81, 95, 97, 99 and 101, as illustrated in FIG. 3.

Figure 4:
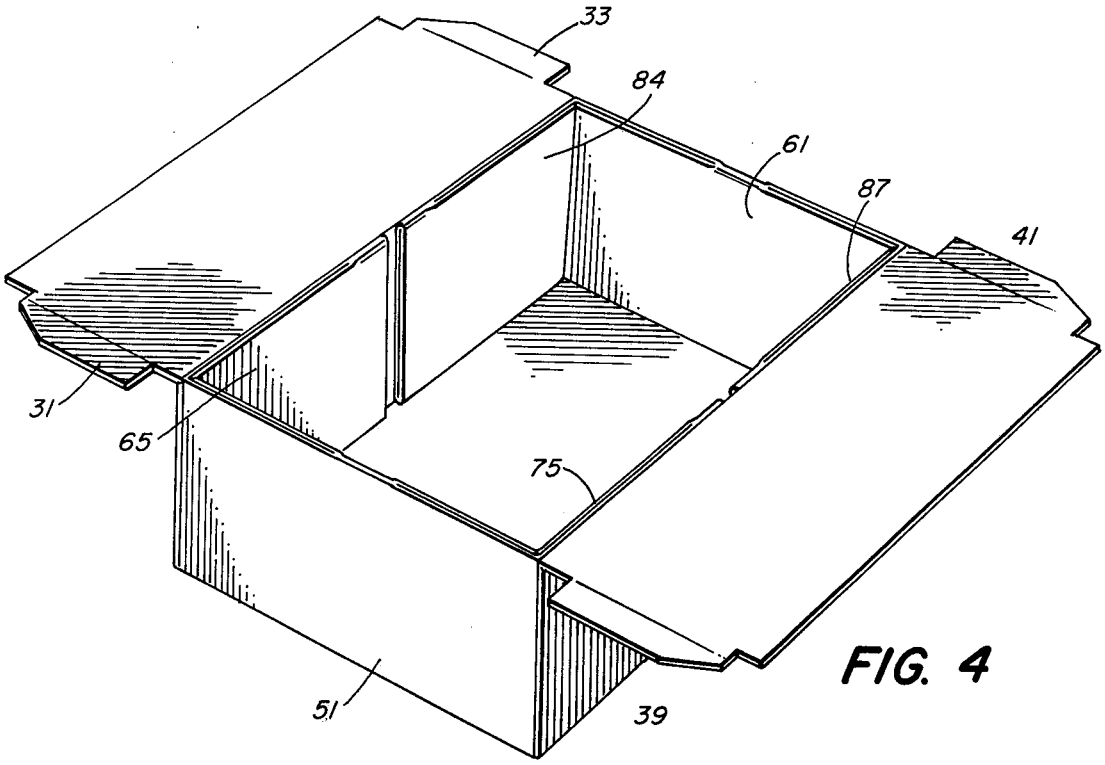

Then, side panels 15 and 17 are folded to a vertical position relative to bottom wall 13 about fold lines 25 and 29, respectively. Side panels 15 and 17 are then secured to end panels 51 and 53 by any suitable means such as tape. The container at this stage in the construction is illustrated in FIG. 4.

Figure 5:
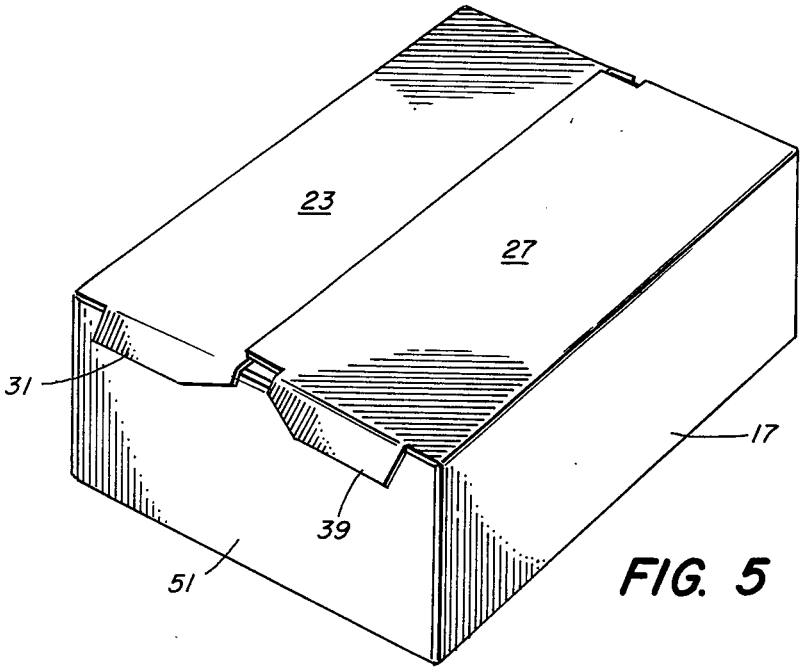
FIG. 5 is a perspective view of the fully assembled container.

Finally the cover flaps 23 and 27 are folded over on their respective side wall panels 15 and 17 about fold lines 25 and 29 to an angle of ninety degrees and side flaps 31, 33, 39 and 41 folded over on their respective cover flaps 23 and 27 about their respective fold lines 35, 37, 43 and 45 to an angle of ninety degrees, as shown in FIG. 5.

When fully erected, the first and second end wall panels form a double end wall and the side wall panel along with the first and second side wall panel sections form a triple side wall to provide a container having superior stacking strength.

It will be understood that various changes in the details, materials, arrangements of parts and method of assembly which have herein been described and illustrated in order to explain the nature of the invention may be made by those skilled in the art within the principles and scope of the invention.

What is claimed is:

1. A one piece blank symmetrical about both transverse and longitudinal perpendicular center lines for use in forming a container of generally rectangular parallelopiped configuration comprising a sheet of material cut and scored to define:

(a) a bottom wall panel of generally rectangular configuration, (b) a pair of side wall panels of generally rectangular configuration hingedly connected to the top and bottom edges of the bottom wall panel, (c) a pair of cover flaps of generally rectangular configuration hingedly connected to the top and bottom edges of the side wall panels, (d) a pair of first end wall panels of generally rectangular configuration hingedly connected to the side edges of the bottom wall panel, (e) a pair of second end wall panels of generally rectangular configuration hingedly connected to the side edges of the first end wall panels, and (f) a first side wall panel section of generally rectangular configuration and of equal length hingedly connected to the top and bottom edges of each first end wall panel, and (g) a second side wall panel section of generally rectangular configuration and of equal length hingedly connected to the bottom and top edge of each second end wall panel.

2. The blank of claim 1 and further including a pair of single panel side flaps hingedly connected to the opposite side edges of each cover flap.

3. The blank of claim 2 and wherein the first and second end wall panel sections are hingedly connected to each other about lateral fold lines.

4. The blank of claim 4 and wherein the fold lines connecting the second panels and their respective panel section are partially slotted.

5. The blank of claim 4 and wherein the blank is made of corrugated paperboard.

6. A container of a generally rectangular parallelopiped configuration made of a single blank of corrugated paperboard and comprising:

(a) a single panel bottom wall, (b) a pair of double panel end walls hingedly connected to opposite side edges of the bottom wall, (c) a pair of triple panel side walls, one panel of each pair being hingedly connected to the bottom wall and the other two panels of each pair being formed from two panels folded back upon itself connected to each of the end walls, each of said double panels being of equal length, (d) a pair of cover flaps hingedly connected to the side walls, and (e) means for securing the panels in an erected condition.

7. The container of claim 7 and wherein the panels are of a generally rectangular configuration.

8. The container of claim 8 and further including side flaps hingedly connected to the cover flaps.

* * * * *

UNITED STATES PATENT AND TRADEMARK OFFICE

CERTIFICATE OF CORRECTION

PATENT NO. : 4,244,507

DATED : January 13, 1981

INVENTOR(S) : Ivan E. Garmon

It is certified that error appears in the above—identified patent and that said Letters Patent is hereby corrected as shown below:

In Column 4, line 43, delete "claim 4" and insert in lieu thereof -- claim 1 --.

In Column 4, line 64, delete "claim 7" and insert in lieu thereof -- claim 6 --.

In Column 4, line 66, delete "claim 8" and insert in lieu thereof -- claim 7 --.

Signed and Sealed this

*Seventeenth* Day of *November 1981*

[SEAL]

*Attest:*

GERALD J. MOSSINGHOFF

*Attesting Officer*

*Commissioner of Patents and Trademarks*